US009381400B2

(12) United States Patent
Chang et al.

(10) Patent No.: US 9,381,400 B2
(45) Date of Patent: Jul. 5, 2016

(54) SEMI-PASSIVE RESISTANCE FORCE CONTROL SYSTEM WITH ACTIVE AUGMENTATION

(71) Applicant: Honix Technology Corp., Taichung (TW)

(72) Inventors: Chao-Kou Chang, Taichung (TW); Wadiatur Rahim, Retreat, VA (US)

(73) Assignee: Honix Technology Corp., Taichung (TW)

( * ) Notice: Subject to any disclaimer, the term of this patent is extended or adjusted under 35 U.S.C. 154(b) by 291 days.

(21) Appl. No.: 13/685,161

(22) Filed: Nov. 26, 2012

(65) Prior Publication Data

US 2014/0148310 A1 May 29, 2014

(51) Int. Cl.

| | |
|---|---|
| ***A63B 21/005*** | (2006.01) |
| ***A63B 24/00*** | (2006.01) |
| ***A63B 21/008*** | (2006.01) |
| *A63B 21/02* | (2006.01) |
| *A63B 22/06* | (2006.01) |

(52) U.S. Cl.

CPC ..... *A63B 24/0087* (2013.01); *A63B 21/0058* (2013.01); *A63B 21/0087* (2013.01); *A63B 21/023* (2013.01); *A63B 22/0605* (2013.01); *A63B 2220/10* (2013.01); *A63B 2220/56* (2013.01)

(58) Field of Classification Search

USPC ..... 482/1, 5, 111–113

See application file for complete search history.

(56) References Cited

U.S. PATENT DOCUMENTS 4,863,161 A * 9/1989 Telle ..... A63B 21/00072 482/112
4,912,638 A * 3/1990 Pratt, Jr. ..... A61B 5/1121 128/905
5,171,196 A * 12/1992 Lynch ..... A63B 21/154 482/54
5,304,104 A * 4/1994 Chi ..... 482/1
5,890,996 A * 4/1999 Frame ..... A63B 21/154 482/111
6,413,195 B1 * 7/2002 Barzelay ..... A63B 21/00178 482/112
7,955,225 B1 * 6/2011 James ..... A63B 22/0664 482/51
7,955,235 B2 6/2011 Keiser (Continued)

FOREIGN PATENT DOCUMENTS

TW M365185 U1 9/2009

OTHER PUBLICATIONS

Office Action dated Jul. 16, 2014 in Taiwanese Application No. 101144083.

*Primary Examiner* — Loan H Thanh
*Assistant Examiner* — Shila Jalalzadeh Abyan
(74) *Attorney, Agent, or Firm* — Wang Law Firm, Inc.

(57) ABSTRACT

Disclosed is a semi-passive resistance force control system with active augmentation, which is suitable for a sport equipment with a pulling part. This semi-passive resistance force control system with active augmentation comprises a resistance force module, an energy neutral apparatus, and a control module. The energy neutral apparatus can not only provide an output resistance force to the pulling part when the pulling part is pulled by a user, but also reduce the variation of the output resistance force. The control module is able to accept the sensing data delivered by the internal sensors of the semi-passive resistance force control system with active augmentation to passively compensate the output resistance force and make it fixed. Furthermore, the control module can also provide an active adjustment to the output resistance force based on a preset control mode such that the user can experience a desired resistance force.

3 Claims, 3 Drawing Sheets

(56) References Cited

U.S. PATENT DOCUMENTS 8,523,789 B2 * 9/2013 Keiser ..... A61B 5/224 482/1
2002/0072452 A1 * 6/2002 Torkelson ..... A63B 23/03541 482/51
2007/0287612 A1 * 12/2007 Cha ..... A63B 21/008 482/111
2010/0029448 A1 * 2/2010 Hayes ..... A63B 21/00069 482/112
2010/0311552 A1 * 12/2010 Sumners ..... A61H 23/0263 482/111

* cited by examiner

SEMI-PASSIVE RESISTANCE FORCE CONTROL SYSTEM WITH ACTIVE AUGMENTATION

BACKGROUND OF THE INVENTION

1. Field of the Invention

The present invention relates to a semi-passive resistance force control system with active augmentation, and particularly, a semi-passive resistance force control system with active augmentation suitable to a sport equipment with a pulling part.

2. Description of the Related Art

Currently, the fast development of electronics and electric-driven machines drives the evolution of the sport facility, which triggers normal users to pursuit functional and personal needs on sport facility. However, the pure passive resistance force system of the current sport facility cannot supply a constant resistance force when a user pulls a pulling part of the sport facility, nor does it meet users' requirement of dynamically adjusting the compensated resistance force during a sport stroke. Thus, it cannot fulfill the above purpose.

BRIEF SUMMARY

Based on the problems of the prior arts, one of the objects of the present invention is to provide a semi-passive resistance force control system with active augmentation to solve the lack of dynamic adjustment of the prior passive resistance force systems which makes them unable to provide a constant resistance force or a dynamically adjustable resistance force during a sport stroke.

Thus, the present invention provides a semi-passive resistance force control system with active augmentation, suitable to a sport equipment with a pulling part, comprising a resistance force adjustment module, an energy neutral apparatus, and a control module. The resistance force adjustment module is connected to the pulling part to actively compensate or adjust the output resistance force. The energy neutral apparatus is connected to the resistance force adjustment module to provide an output resistance force to the pulling part when a user is pulling a moving part of the energy neutral apparatus by way of the pulling part and the resistance force adjustment module. The control module is electrically connected to the gas supply module and the resistance force adjustment module. The control module sets up the preset gas pressure of the gas supply module and controls the resistance force adjustment module to adjust the output resistance force of the piston resistance force module and to generate an adjustment resistance force, such that the user experiences a desired resistance force when pulling the pulling part.

Furthermore, the energy neutral apparatus comprises a piston resistance force module and a gas supply module. The piston resistance force module is connected to the resistance force adjustment module to provide an output resistance force to the pulling part when a user is pulling a piston of the piston resistance force module. The gas supply module is connected to the piston resistance force module to set a preset gas pressure of the piston resistance force module before the piston is pulled and control the output resistance force provided by the piston resistance force module to obey a first preset mode by using a gas interconnection between the gas supply module and the piston resistance force module when the piston is pulled by a user.

Furthermore, the gas supply module comprises a gas pressure sensor and a gas reservoir, the gas pressure sensor and gas reservoir are connected to the piston resistance force module through a gas pipe. The gas pressure sensor measures the gas pressure of the gas pipe, converts it into an electrical signal, and sends it to the control module. The gas pipe is connected to an external gas source through a source control valve, the source control valve is controlled by a first control command of the control module to open or close. The gas pipe is connected to an external environment through a vent control valve, the vent control valve is controlled by a second control command of the control module to open or close. The gas content of the gas reservoir is a plurality of times of that of the piston resistance force module, e.g. 9 times.

Furthermore, the resistance force adjustment module comprises an position sensor, an electrical motor, and a coupler; the coupler is mechanically connected to the electrical motor, the piston resistance force module, and the pulling part; the position sensor detects a movement distance of the pulling part, convert the movement distance into a electrical signal, and sends the electrical signal to the control module; the control module controls the output torque of the electrical motor based on the electrical signal of the gas pressure sensor and the electrical signal of the position sensor to provide the adjustment resistance force to the coupler, thus the output resistance force and the adjustment force are integrated into the desired resistance force to deliver to the pulling part.

The coupler comprises a first revolving wheel, a second revolving wheel, a third revolving wheel coaxially; the first revolving wheel is mechanically connected to the piston resistance force module to convert the output resistance force of the piston resistance force module into a first torque; the third revolving wheel is mechanically connected to the electrical motor to convert the adjustment resistance force into a second torque; the second revolving wheel is mechanically connected to the pulling part to convert the first torque and the second torque through a common axis to output the desired resistance force to the pulling part. The radius ratio of the first revolving wheel, the third revolving wheel, and the second revolving wheel is decided by the ratio and magnitudes of the output resistance force of the piston resistance force module, the adjustment force of the electrical motor, and the desired resistance force.

Furthermore, the control module decides to open or close the source control valve and the vent control valve based on the preset gas pressure and the electrical signal of the gas pressure sensor to make the gas supply module achieve the preset gas pressure, in turns to generate the desired resistance force, the control module is also able to dynamically adjust the preset gas pressure of the gas supply module to generate the desired resistance force; the control module derives a force difference between the output resistance force and the desired resistance force through a gas pressure deviation detected by the gas pressure sensor during the movement of the piston; the control module utilizes the movement distance of the pulling part detected by the position sensor and a second control mode to generate an active adjustment value, then the control module derives the adjustment resistance force based on the force difference and the active adjustment value.

As above-mentioned, the semi-passive resistance force control system with active augmentation of the present invention may have one or more characteristics and advantages as described below:

(1) The present invention comprises a gas reservoir such that the output resistance force of the piston resistance force module follows a more stable preset mode through the gas interconnection of the gas supply module with the piston resistance force module.

(2) The present invention comprises a gas pressure sensor such that the gas pressure change due to the movement of the piston is detected instantly, and then the electrical signal of the gas pressure sensor is transferred to the control module. Based on the electrical signal of the gas pressure sensor, the control module controls the resistance force adjustment module to actively compensate the deviation of the output resistance force due to the gas pressure change such that the output resistance force remained fixed.

(3) The present invention comprises a position sensor such that the movement distance of the pulling part is detected instantly when the piston of the piston of the piston resistance force module is pulled, and then the electrical signal of the position sensor is transferred to the control module. Based on the electrical signal of the position sensor, the control module executes an active adjustment to the output resistance force in according with a second preset mode such that the user can experience the desired resistance force.

DETAILED DESCRIPTION

With reference to the drawings, thereafter, the preferred embodiments of a semi-passive resistance force control system with active augmentation in accordance with the present invention are illustrated. In order to be understood easily, the same components in the following embodiments are labeled as the same numeral.

The present discloses a semi-passive resistance force control system with active augmentation, which is suitable for a sport equipment with a pulling part. The semi-passive resistance force control system with active augmentation comprises a resistance force adjustment module, an energy neutral apparatus, and a control module. The energy neutral apparatus not only provides an output resistance force to the pulling part when the pulling part is pulled by a user, but also reduces the change of the output resistance force due to the piston movement. Based on the detection data of the system internal sensors during the movement of the pulling part, the control module is not only able to passively compensate the output resistance force to make it fixed, but also to add on an active adjustment to the output resistance force in accordance with a preset mode such that the user can experience a desired resistance force. For example, the desired resistance force can be set to be linearly proportional to the movement distance of the pulling part to train the upper body or the legs of the user. The energy neutral apparatus of the present invention comprises a moving part, e.g. a recoiling spring or a piston resistance force module and a gas supply module.

Figure 1:
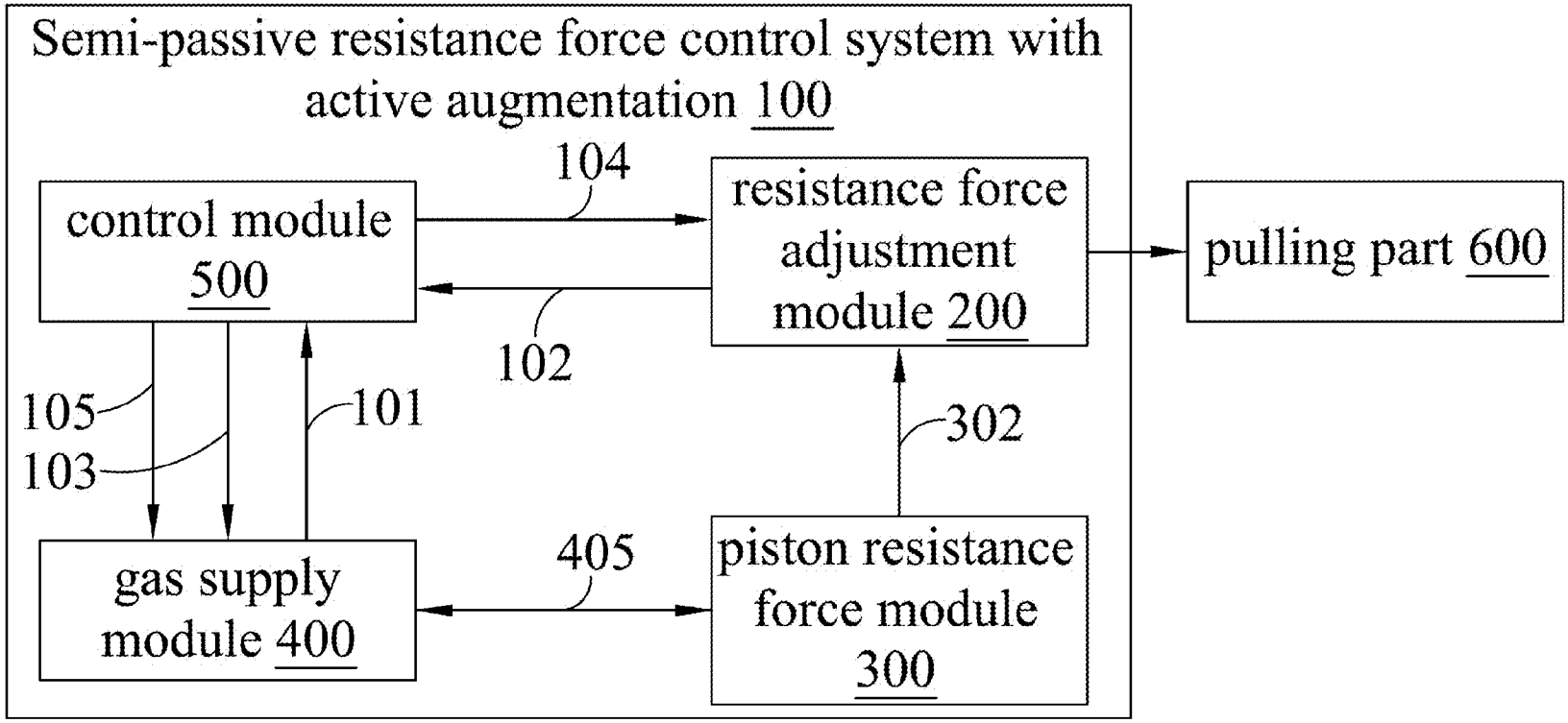
FIG. 1 is a block diagram showing a semi-passive resistance force control system with active augmentation according to the preferred embodiment of the present invention.
Figure 2:
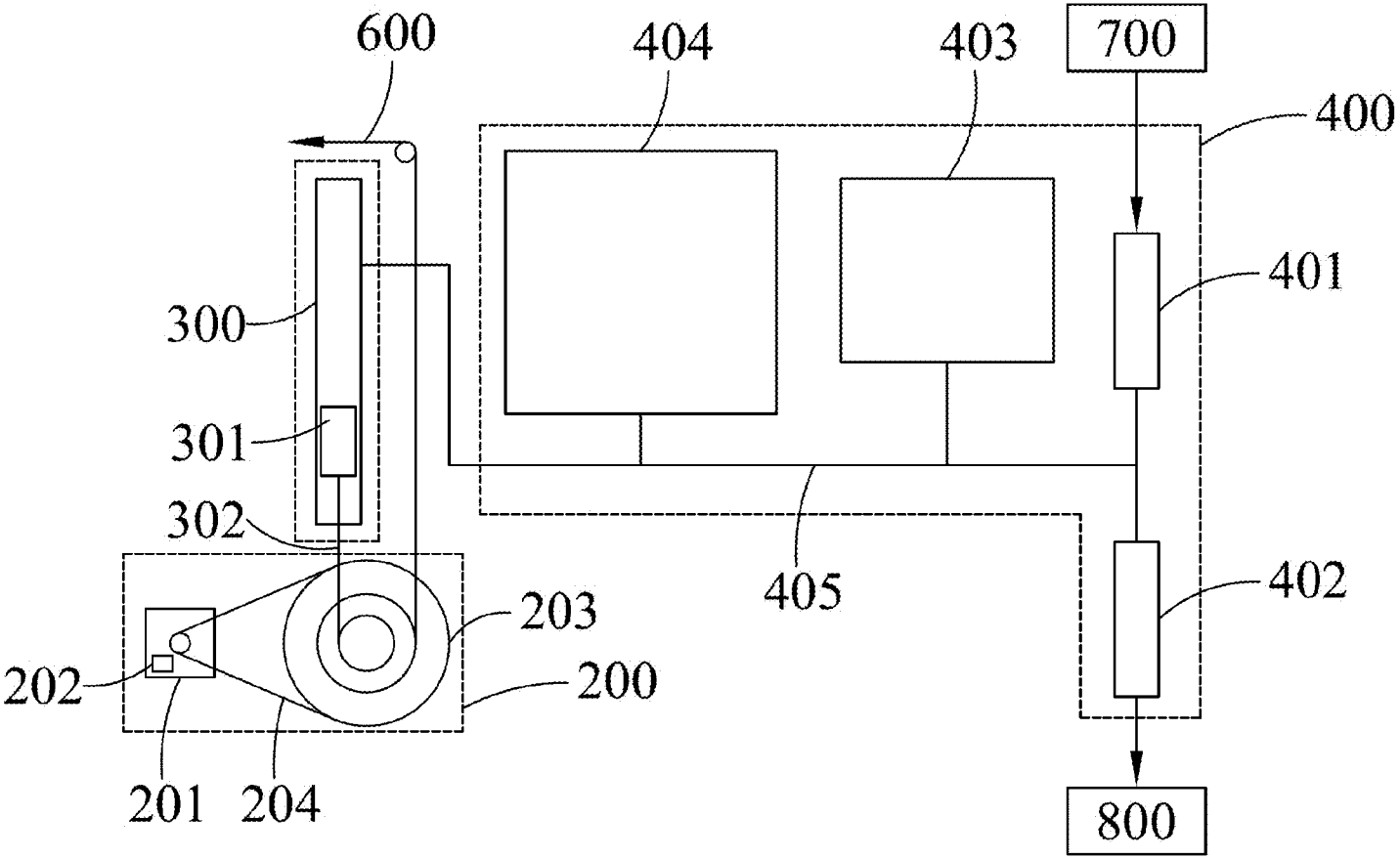
FIG. 2 is a mechanical structure diagram showing a semi-passive resistance force control system with active augmentation according to the preferred embodiment of the present invention.

Referring to FIG. 1 and FIG. 2. FIG. 1 is a block diagram showing a semi-passive resistance force control system with active augmentation according to the preferred embodiment of the present invention. FIG. 2 is a mechanical structure diagram showing a semi-passive resistance force control system with active augmentation according to the preferred embodiment of the present invention.

The semi-passive resistance force control system with active augmentation 100 comprises a resistance force adjustment module 200, an energy neutral apparatus, and a control module 500. In this preferred embodiment the energy neutral apparatus comprises a piston resistance force module 300 and a gas supply module 400. Besides, the moving part of the energy saving module is for example a piston 301.

The resistance force adjustment module 200 is connected to the pulling part 600 to actively compensate or adjust the output resistance force. The piston resistance force module 300 is mechanically connected through a driving part 302 to the resistance force adjustment module 200 to provide an output resistance force to the pulling part 600 when a user is pulling a piston 301 of the piston resistance force module 300. The gas supply module 400, connected to the piston resistance force module 300 through a gas pipe 405 to set a preset gas pressure of the piston resistance force module 300 before the piston 301 is pulled and control the output resistance force provided by the piston resistance force module 300 to obey a first preset mode when the piston 301 is pulled by a user through a gas interconnection between the gas supply module 400 and the piston resistance force module 300. The control module 500 is electrically connected to the gas supply module 400 and the resistance force adjustment module 300; the control module 500 sets up the preset gas pressure of the gas supply module 400 by using the first control command 103 and the second control command 105. Moreover, the control module 500 controls the resistance force adjustment module 200 through the third control command 104 to adjust the output resistance force of the piston resistance force module 300 and the adjustment resistance force of the resistance force adjustment module 200 such that the user experiences a desired resistance force when pulling the pulling part 600.

Furthermore, as shown in FIG. 2, the gas supply module 400 comprises a gas pressure sensor 403 and a gas reservoir 404, the gas pressure sensor 403 and gas reservoir 404 are connected to the piston resistance force module 300 through a gas pipe 405. The gas pressure sensor 403 measures the gas pressure of the gas pipe 405, converts it into an electrical signal 101, and sends it to the control module 500. The gas pipe 405 is connected to an external gas source 700 through a source control valve 401, the source control valve 401 is controlled by a first control command 103 of the control module 500 to open or close. The gas pipe 405 is connected to an external environment 800 through a vent control valve 402, the vent control valve 402 is controlled by a second control command 105 of the control module 500 to open or close.

When using the semi-passive resistance force control system with active augmentation of the present invention, the user can set up the preset gas pressure through the control module 500. Based on this preset gas pressure and the electrical signal 101 of the gas pressure sensor 403 to decide to open or close the source control valve and the vent control valve such that the gas supply module 400 and the piston resistance force module 300 can reach the preset gas pressure.

When a user is pulling part 600, the pulling part 600 will pull the piston 301 of the piston resistance force module 300 through the resistance adjustment module 200 and the driving part 302 such that the internal content and pressure of piston resistance force module will be changed. This gas pressure change can be reduced by the gas interconnection of the gas supply module 400 and the piston resistance force module 300 such that the output resistance force of the piston resistance force module 300 to vary in a more stable fashion of the first preset mode, this can prevent the user to suffer from a too large resistance force change. To reach this goal, the gas content of the gas reservoir 404 is a plurality of times of that of the piston resistance force module 300, e.g. 9 times.

Furthermore, as shown in FIG. 2, the resistance force adjustment module 200 comprises an electrical motor 201, an position sensor 202, and a coupler 203; the coupler 203 is mechanically connected to the electrical motor 201, the piston resistance force module 300, and the pulling part 600; the position sensor 202 detects a movement distance of the pulling part 600, convert the movement distance into a electrical signal 102, and sends the electrical signal 102 to the control module 500; the control module 500 controls the output torque of the electrical motor 201 based on the electrical signal 101 of the gas pressure sensor 101 and the electrical signal 102 of the position sensor 202 to provide the adjustment resistance force to the coupler 203, thus the output resistance force and the adjustment force are integrated into the desired resistance force to deliver to the pulling part 600.

Figure 3:
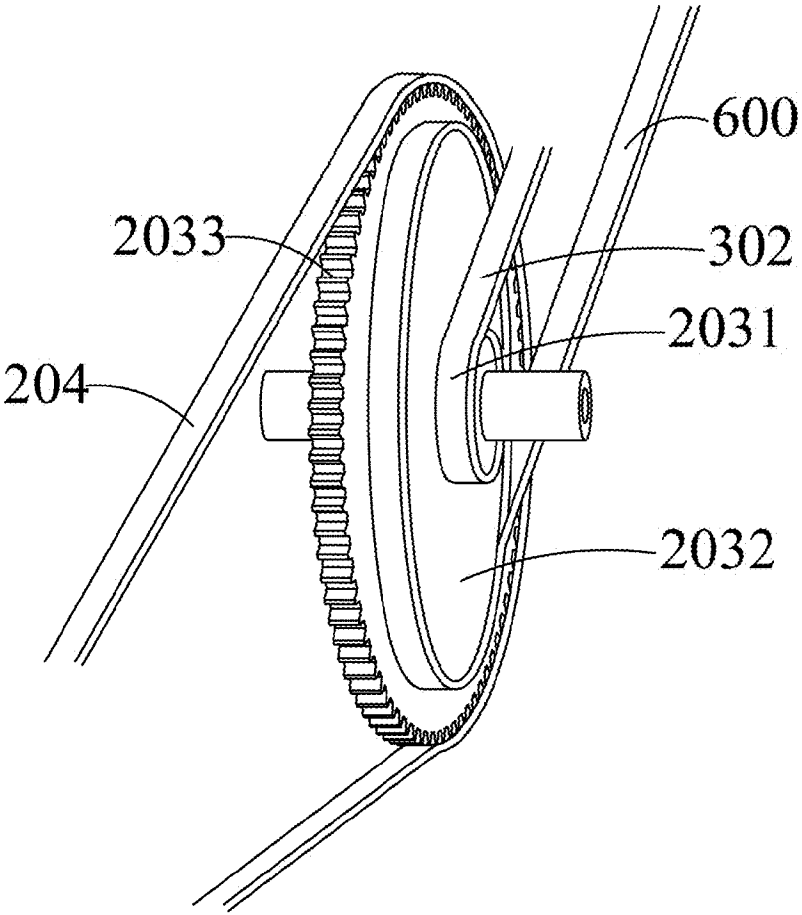
FIG. 3 is a coupler structure diagram showing a semi-passive resistance force control system with active augmentation according to the preferred embodiment of the present invention.

Referring to FIG. 3. FIG. 3 is a coupler structure diagram showing a semi-passive resistance force control system with active augmentation according to the preferred embodiment of the present invention. The coupler 203 comprises a first revolving wheel 2031, a second revolving wheel 2032, a third revolving wheel 2033 coaxially; the first revolving wheel 2031 is mechanically connected to the piston resistance force module 300 through a driving part 302 to convert the output resistance force of the piston resistance force module 300 into a first torque; the third revolving wheel 2033 is mechanically connected to the electrical motor 201 through a driving part 204 to convert the adjustment resistance force into a second torque; the second revolving wheel 2032 is mechanically connected to the pulling part 600 to convert the first torque and the second torque through a common axis to output the desired resistance force to the pulling part 600. The radius ratio of the first revolving wheel 2031, the third revolving wheel 2033, and the second revolving wheel 2032 is decided by the ratio and magnitudes of the output resistance force of the piston resistance force module, the adjustment force of the electrical motor, and the desired resistance force.

Furthermore, the control module 500 decides to open or close the source control valve 401 and the vent control valve 402 based on the preset gas pressure and the electrical signal 101 of the gas pressure sensor 403 to make the gas supply module 400 achieve the preset gas pressure, in turns to generate the desired resistance force, the control module is also able to dynamically adjust the preset gas pressure of the gas supply module to generate the desired resistance force; the control module 500 derives a force difference between the output resistance force and the desired resistance force through a gas pressure deviation detected by the gas pressure sensor 403 during the movement of the piston 301 when the user is pulling the pulling part 600; the control module 500 utilizes the movement distance of the pulling part 600 detected by the position sensor 202 and a second control mode to generate an active adjustment value, then the control module 500 derives the adjustment resistance force based on the force difference and the active adjustment value and sends out a third control command 104 to control the electric motor 401 to generate the demanded adjustment resistance force.

For example, when the gas pressure is roughly 21 pounds/squared inch, the output resistance force provided by the gas supply module 400 and piston resistance force module 300 is around 30 kgws, the resistance force adjustment module can generate the adjustment resistance force of about ±30 kgws under this condition. Besides, if the output resistance force provided by the gas supply module 400 and piston resistance force module 300 is 115 kgws, the resistance force adjustment module can generate the adjustment resistance force of about ±35 kgws under this condition. By combining the above resistance forces together under different conditions, the user can adjust the desired resistance force based on his or her physical conditions and exercise needs.

In summary, the semi-passive resistance force control system with active augmentation of the present invention provides an output resistance force when a user pulls the pulling part 600 by using the combination of gas supply module 400 and the piston resistance force module 300, and also reduce the output resistance force change due to the movement of the piston 301. Based on the feedback sensing data of the gas pressure sensor 403 and the position sensor 202 when a user is pulling the pulling part 600, the control module 500 not only can passively compensate the output resistance force to make it more stable and uniform, but also actively adjust the output resistance force according to a such that the user can experience a desired resistance force and uses it to train his or her upper body or leg muscles.

In summation, although the present invention has been described with reference to the foregoing preferred embodiment, it will be understood that the invention is not limited to the details thereof. Various equivalent variations and modifications may still occur to those skilled in this art in view of the teachings of the present invention. Thus, all such variations and equivalent modifications are also embraced within the scope of the invention as defined in the appended claims.

What is claimed is:

1. A semi-passive resistance force control system with active augmentation, for use with an exercise equipment with a pulling part, comprising:

a resistance force adjustment module, connected to a pulling part of an exercise equipment;

an energy neutral apparatus, connected to the resistance force adjustment module to provide an output resistance force to the pulling part when a user is pulling a moving part of the energy neutral apparatus by way of the pulling part and the resistance force adjustment module; and a control module, electrically connected to the energy neutral apparatus and the resistance force adjustment module; wherein the control module sets up a preset gas pressure of the energy neutral apparatus and controls the resistance force adjustment module to actively compensate a deviation of the output resistance force from a desired resistance force due to a gas pressure change when pulling the pulling part and to generate an adjustment resistance force, such that the user experiences the desired resistance force when pulling the pulling part;

wherein the energy neutral apparatus comprises a piston resistance force module and a gas supply module, the piston resistance force module is connected to the resistance force adjustment module to provide the output resistance force to the pulling part when the user is pulling a piston of the piston resistance force module, and the gas supply module is connected to the piston resistance force module to set the preset gas pressure of the piston resistance force module before the piston is pulled and control the output resistance force provided by the piston resistance force module to obey a first preset mode by using a gas interconnection between the gas supply module and the piston resistance force module when the piston is pulled by the user;

wherein the gas supply module comprises a gas pressure sensor and a gas reservoir, the gas pressure sensor and the gas reservoir are connected to the piston resistance force module through a gas pipe;

wherein the gas pressure sensor measures a gas pressure of the gas pipe, converts it into an electrical signal, and sends it to the control module;

wherein the gas pipe is connected to an external gas source through a source control valve, the source control valve is controlled by a first control command of the control module to open or close, the gas reservoir is in communication with the piston resistance force module when the source control valve is closed, and a gas content of the gas reservoir is a plurality of times of that of the piston resistance force module, so as to enable the gas pressure of the piston resistance force module to stably change when the source control valve is closed and the user is pulling the pulling part;

wherein the gas pipe is connected to an external environment through a vent control valve, the vent control valve is controlled by a second control command of the control module to open or close;

wherein the resistance force adjustment module comprises an electrical motor and a coupler, the coupler is used to integrate the output resistance force and the adjustment resistance force of the electric motor into the desired resistance force;

wherein the resistance force adjustment module further comprises a position sensor;

the coupler is mechanically connected to the electrical motor, the piston resistance force module, and the pulling part;

the position sensor detects a movement distance of the pulling part, converts the movement distance into an electrical signal, and sends the electrical signal to the control module;

the control module dynamically controls the output torque of the electrical motor based on the electrical signal of the gas pressure sensor and the electrical signal of the position sensor to provide the adjustment resistance force to the coupler, thereby integrating the output force and the adjustment force into the desired resistance force to deliver to the pulling part when the user is pulling the pulling part; and wherein the coupler comprises a first revolving wheel, a second revolving wheel, and a third revolving wheel arranged coaxially;

the first revolving wheel is mechanically connected to the piston resistance force module to convert the output resistance force of the piston resistance force module into a first torque;

the third revolving wheel is mechanically connected to the electrical motor to convert the adjustment resistance force into a second torque; and the second revolving wheel is mechanically connected to the pulling part to convert the first torque and the second torque through a common axis to output the desired resistance force to the pulling part.

2. The semi-passive resistance force control system with active augmentation of claim 1, the radius ratio of the first revolving wheel, the third revolving wheel, and the second revolving wheel is decided by the ratio and magnitudes of the output resistance force of the piston resistance force module, the adjustment resistance force of the electrical motor, and the desired resistance force.

3. The semi-passive resistance force control system with active augmentation of claim 2, the control module decides to open or close the source control valve and the vent control valve based on the preset gas pressure and the electrical signal of the gas pressure sensor to make the gas supply module achieve the preset gas pressure, in turns to generate the desired resistance force, the control module is also able to dynamically adjust the preset gas pressure of the gas supply module to generate the desired resistance force; the control module derives a force difference between the output resistance force and the desired resistance force through a gas pressure deviation detected by the gas pressure sensor during the movement of the piston; the control module utilizes the movement distance of the pulling part detected by the position sensor and a second control mode to generate an active adjustment value, then the control module derives the adjustment resistance force based on the force difference and the active adjustment value.

* * * * *